US005605469A

United States Patent [19]

Wellinsky et al.

[11] Patent Number: 5,605,469

[45] Date of Patent: Feb. 25, 1997

[54] ELECTRICAL CONNECTOR HAVING AN IMPROVED CONDUCTOR HOLDING BLOCK AND CONDUCTOR SHIELD

[75] Inventors: Wayne T. Wellinsky, Moore; Randal B. Lord, Inman, both of S.C.

[73] Assignee: Thomas & Betts Corporation, Memphis, Tenn.

[21] Appl. No.: 369,062

[22] Filed: Jan. 5, 1995

[51] Int. Cl.[6] ..... H01R 4/24

[52] U.S. Cl. ..... 439/417; 439/607

[58] Field of Search ..... 439/395–405, 439/417–419, 409, 411, 412, 607

[56] References Cited

U.S. PATENT DOCUMENTS

| | | | |
|---|---|---|---|
| 4,536,053 | 8/1985 | Maros | 339/143 |
| 4,619,487 | 10/1986 | Brush, Jr. | 339/14 |
| 4,624,515 | 11/1986 | Brush, Jr. et al. | 339/14 |
| 4,820,179 | 4/1989 | Saijo | 439/224 |
| 4,846,727 | 7/1989 | Glover et al. | 439/608 |
| 4,917,629 | 4/1990 | Matsuzaki et al. | 439/405 |
| 4,919,629 | 4/1990 | Matsuzaki | 439/405 |
| 4,932,888 | 7/1990 | Senor | 439/108 |
| 4,950,172 | 8/1990 | Anhalt et al. | 439/108 |
| 5,046,960 | 9/1991 | Fedder | 439/108 |
| 5,104,341 | 4/1992 | Gilissen et al. | 439/608 |
| 5,194,014 | 3/1993 | McClune et al. | 439/404 |
| 5,328,380 | 7/1994 | Carney . | |
| 5,487,682 | 1/1996 | Miller et al. . | |

*Primary Examiner*—David L. Pirlot

*Attorney, Agent, or Firm*—Michael L. Hoelter; Salvatore J. Abbruzzese

[57] ABSTRACT

An electrical connector provides for the termination of discrete conductors of a multi-conductor cable. The connector includes a connector housing which supports a plurality of electrical contacts. The contacts include insulation displacing contact portions. The insulation displacing contact portions are arranged in longitudinally and vertically spaced rows within the connector housing. A conductor holding block is movably supported by the housing with respect to the insulation displacing contact portions. The conductor holding block includes contact slots which are longitudinally and vertically spaced for receipt of the insulation displacing contact portions. The holding block further includes vertically spaced rows of conductor receiving passages in communication with the contact slots for receipt of the conductors in a pair of conductor rows. The connector further includes a conductive shield positioned between the vertically spaced rows of terminated conductors so as to shield the terminations of one row of conductors from the conductors of the other row.

17 Claims, 2 Drawing Sheets

ELECTRICAL CONNECTOR HAVING AN IMPROVED CONDUCTOR HOLDING BLOCK AND CONDUCTOR SHIELD

FIELD OF THE INVENTION

The present invention relates generally to improvements in electrical data connectors. More particularly the present invention relates to a shielded compact data connector which permits the termination of plural conductors with reduced cross-talk between terminated conductors.

BACKGROUND OF THE INVENTION

In the field of data/communications technology, information in the form of electrical signals is being transmitted at ever increasing speeds. Along with the desire to transmit information at faster data rates, the industry has also seen the need to reduce the size of hardware employed so as to increase portability and ease of use. In order to keep pace with these improvements, interconnection technology, which includes electrical cables and electrical connectors designed to connect such hardware, has also undergone significant changes. Electrical connectors and cables are now available, which are much smaller in size and may include a higher density of conductive components. These compact data connectors permit the reliable termination of a greater number of electrical conductors within a smaller connector housing. Further, these compact data connectors are also capable of transmitting data at higher data rates.

Such continued improvements in connection technology are not without problems. By decreasing the size of electrical connectors and increasing their density, while still requiring the connectors to transmit data at higher rates, cross-talk between adjacent conductive components within the connector becomes a factor which must be addressed. Additionally, as these components are normally used in close proximity to other electronic components, the individual connector components must be shielded from external interferences such as electro-magnetic interferences (EMI) and radio-frequency interferences (RFI). These interferences can adversely affect the performance levels of the connectors especially at the higher data rates. Thus overall shielding of the connector as well as shielding of the conductive components within the connector becomes a challenge in advancing connector technology.

An additional demand on connector technology is that the connector components must be field installable, that is, the cable is to be terminated by the end user at the location of use. Thus, the components must be easy to field assemble and must provide for accurate termination of a multiplicity of conductors.

It can be appreciated that merely "downsizing" a connector will be insufficient to meet the current requirements of the industry. Smaller connectors must be designed to meet increased signal transmission requirements, by providing both internal and external shielding as well as providing for long term reliable mechanical and electrical performance.

SUMMARY OF THE INVENTION

It is an object of the present invention to provide a shielded electrical connector for terminating discrete conductors of a multi-conductor cable.

It is a further object of the present invention to provide an electrical connector having a conductor shield which provides electrical shielding between conductors terminated by the connector.

It is a still further object of the present invention to provide an electrical connector including a conductor holding block which supports plural conductors of a multi-conductor cable adjacent insulation displacing contacts of the connector, such conductor holding block including a conductive shield for shielding one set of terminated conductors from an adjacent set of terminated conductors.

In the efficient attainment of these and other objects, the present invention provides an electrical connector for terminating individually insulated conductors of a multi-conductor cable. The connector includes an insulative housing which supports plural electrical contacts therein. The contacts include insulation displacing contact portions which are aligned in a longitudinally and vertically spaced arrangement. A conductor holding block is movably supported by the housing for insertable movement with respect to the insulation displacing contact portions. The conductor holding block includes individual contact slots for receipt of the insulation displacing contact portions upon movement of the holding block with respect to said housing. The conductor holding block further includes vertically spaced conductor receiving passages in communication with the contact slots for receipt of the individually insulated conductors of the cable and for alignment of the conductors with the insulation displacing contact portions and for simultaneous insulation displacing termination therewith.

As more particularly described by way of the preferred embodiment herein, the insulation displacing contact portions are generally aligned in a pair of contact rows which are longitudinally and vertically spaced. The connector further includes an electrically conductive conductor shield which is positionable over one of the rows of insulation displacing contact portions. The conductor shield shields one row of terminated conductors from the conductors terminated by the other row of contacts to provide electrical shielding therebetween. The conductor shield may be supported by the conductor holding block for movement therewith.

DETAILED DESCRIPTION OF THE PREFERRED EMBODIMENT

Figure 1:
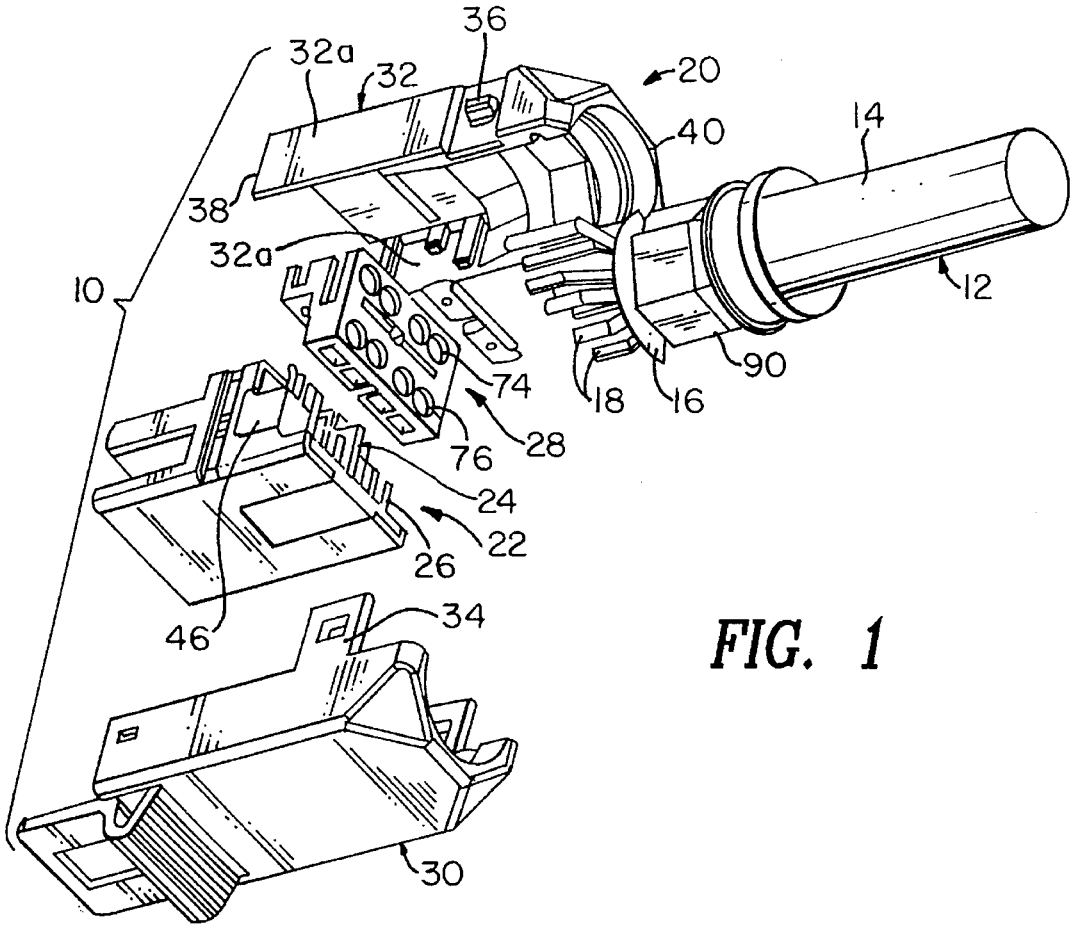
FIG. 1 is an exploded perspective view of the compact data connector of the present invention and a shielded multi-conductor electrical cable positioned for termination therewith.

Referring to FIG. 1, a high-density compact electrical data connector 10 of the present invention is shown. Data connector 10 is of the type used to terminate a multi-conductor electrical cable 12 which is designed for transmitting signals between electronic components. Cable 12 may include an outer insulative jacket 14, an inner conductive cable shield 16 and a plurality of individually insulated discrete electrical conductors 18 extending therethrough. In order to prepare cable 12 for termination with connector 10, an end portion of jacket 14 is cut away exposing a portion of cable shield 16 and an extent of conductors 18 of length suitable for termination.

connector 10 of the present invention is of a type similar to that shown and described in U.S. patent application Ser. No. 08/153,687 filed on Nov. 17, 1993 and entitled, "ELECTRICAL CONNECTOR HAVING A CONDUCTOR HOLDING BLOCK", which is assigned to the assignee of the present invention and which is incorporated by reference herein for all purposes.

Connector 10 includes an outer housing 20, a termination subassembly 22, upper and lower rows of electrical contacts 24 and 26 and a conductor holding block 28. Each of the components of connector 10 are further described hereinbelow.

Outer housing 20 is generally an elongate rectangular member formed of two mating parts including a base 30 and cover 32. Outer housing 20 is a generally formed of a suitably insulated plastic such as polyester. Base 30 may include upwardly extending arms 34 which engage protrusions 36 on cover 32 to provide snap-fit engagement of cover 32 on base 30. Housing 20 includes an interconnection end 38 which is designed for mating electrical interconnection with a mating electrical connector. Such mating connection may be generally of the hermaphroditic type, i.e., the mating connector may be of similar construction to that of connector 10. Housing 20 further includes an opposed cable receiving end 40 which accommodates electrical cable 12. As housing 20 is preferably formed of an electrically insulative plastic, in order to assist in shielding connector 10 from external electrical interferences such as RFI and EMI, both base 30 and cover 32 may be internally and/or externally electrolessly plated with a metallic plating such as nickel and/or copper. The process of metallically plating a plastic member may be accomplished in any manner which is well-known in the plating art.

Figure 2:
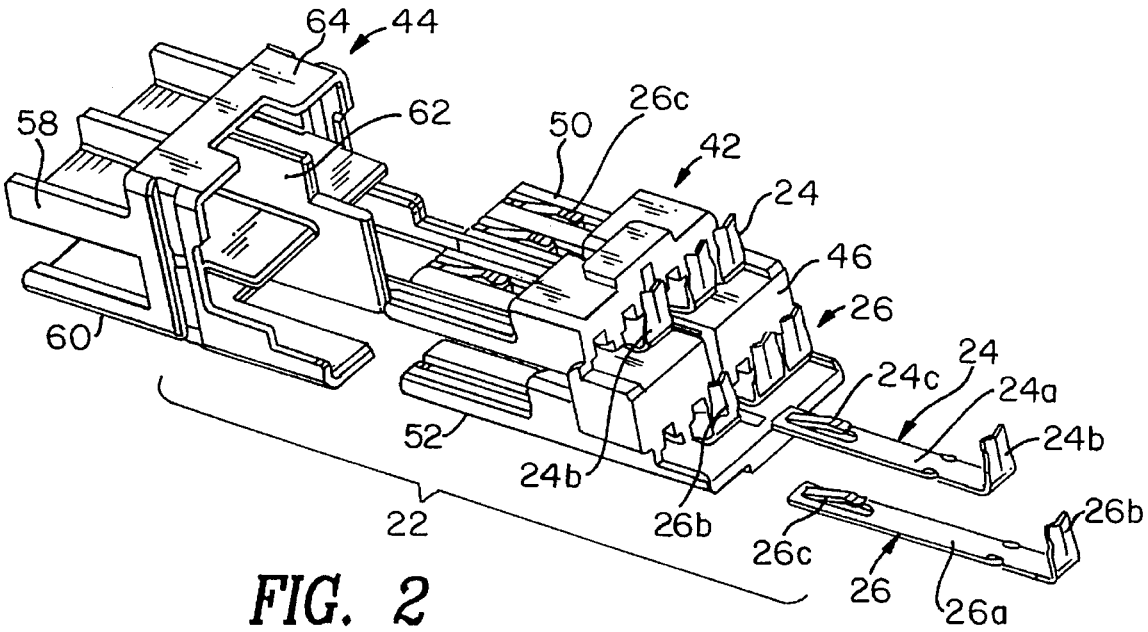
FIG. 2 is an exploded perspective view of the termination subassembly of the connector of FIG. 1.

Referring additionally to FIG. 2, termination subassembly 22 is shown. Termination subassembly 22 includes a contact support member 42 which supports electrical contacts 24 and 26 and further includes an outer conductive shield 44.

Contact support member 42 is generally an elongate molded plastic member typically formed of polyester having a rear contact accommodating end 46, a central main body 48, and forwardly extending upper and lower support platforms 50 and 52. Contact support member 42 includes a row of side-by-side upper channels 54 extending from rear contact accommodating end 46 through central main body 48 and along upper support platform 50. Similarly, a row of side-by-side lower channels 56 extend from rear contact accommodating end 46 through central main body 48 and along lower support platform 52.

Upper and lower electrical contacts 24 and 26, which are supported by contact support member 42, are typically stamped and formed metallic members formed of beryllium copper or other suitably conductive metal. Lower contacts 26 include a generally elongate base portion **26*a*, an upstanding insulation displacing contact (IDC) portion 26*b* and a reversely directed cantilevered spring portion 26*c* which extends back over base portion 26*a*. The cantilevered spring portion 26*c* is constructed so as to be deflectable for movement toward and away from base portion 26*a*** upon interconnection with contacts of a mating connector.

Upper contacts 24 are of construction similar to that of lower contacts 26. Each contact includes an elongate base portion **24*a*, an upwardly extending insulation displacement contact (IDC) portion 24*b* and a reversely directed cantilevered spring portion 24*c***.

In the present illustrative embodiment, contacts 24 and 26 are positioned in support member 42 in two transversely aligned, vertically spaced rows. Each row includes four contacts having base portions **24*a* and 26*a* supported by upper and lower support platforms 50 and 52, respectively. The opposed IDC portions 24*b* and 26*b* are supported above one another adjacent rear contact accommodating end 46 of contact support member 42. The base portion 24*b* of lower contacts 24 are longer than the base portion 26*b* of contact 26 so that the IDC portions of each row of contacts 24 and 26 are longitudinally offset as well as being transversely aligned and vertically spaced apart. Rear contact accommodating end 46 is formed in a step-wise configuration to accommodate support longitudinally staggered IDC portions 24*b* and 26*b***.

As shown in FIG. 2, contacts 24 and 26 are accommodated within upper and lower channels 54 and 56, respectively. In order to shield selected adjacent pairs of contacts 24 and 26 from electrical cross-talk, contact support member 42 is insertable within outer conductive shield 44. Outer conductive shield 44 may be formed of die-cast zinc and includes a pair of upper and lower shield platforms 58 and 60 which underlie respectively support platforms 50 and 52. Shield platforms 58 and 60 provide electrical shielding between the vertically spaced rows of contacts 24 and 26. Outer conductive shield 44 further includes a vertical shield wall 62 which extends centrally between side-by-side pairs of contacts 24 and 26. In this manner, side-by-side pairs of contacts 24 and 26 are shielded from adjacent lateral pairs of contacts reducing cross-talk therebetween. Outer conductive shield 44 includes an outer shell portion 64 surrounding shield platforms 58 and 60. When assembled in connector 20, shell portion 64 engages the metallic plating of base 30 and cover 32 to provide ground path continuity therebetween.

Referring again to FIGS. 3 and 2, extending insulated conductors 18 of cable 12 are positioned for insulation displacing electrical connection with IDC portions **24*b* and 26*b* of contacts 24 and 26. In order to accurately align conductors 18 with the insulation displacing portions, the present invention provides conductor holding block 28 which is insertably accommodated by termination subassembly Referring additionally to FIGS. 3 and 4, holding block 28 is generally a rectangular member formed of a suitably insulated plastic such as polycarbonate, having a shape which is mateable with contact accommodating end 46 of contact support member 42. Holding block 28 includes a generally step-like configuration defining a smaller forward portion 66 and a larger rearward portion 68. Holding block 28 includes a first row of contact slots 70 extending upwardly through forward portion 66 and a second row of contact slots 72 extending upwardly through rearward portion 68. Contact slots 70 and 72 are designed for insertable accommodation of insulation displacing portions 24*b* and 26*d* respectively of contacts 24 and 26 upon attachment of holding block 28 to contact support member 42. Conductor holding block 28 further includes an upper row of conductor passages 74 and an aligned lower row of conductor passages 76. Passages 74 and 76 extend generally horizontally from a rear face 28*a* of holding block 28. Upper passages 74 are designed for communication with slots 70** of holding block 28 while lower passages 76 are designed for communication with slots 72 thereof. As slots 70 and 72 receive the IDC portions therein, passages 74 and 76 provide for individual conductor positioning adjacent the respective IDC portions. In order to accommodate IDC portions 24*b* and 26*b* supported by contact support member 42, slots 70 and 72 of holding block 28 are vertically spaced and longitudinally offset in a manner similar to that of the IDC portions. Passages 74 and 76 are transversely aligned and vertically spaced in order to dispose conductors 18 inserted therein over the IDC portions 24*b*, 26*b* for termination therewith. However, as conductors 18 are supported in stacked fashion in two aligned vertically spaced rows, conductors 18 extending through upper passages 74 are positioned directly above conductors 18 extending through passages 76. This arrangement may result in an increase in cross-talk between the terminated conductors, as IDC portions 26*b* lie directly below the conductors 18 extending from IDC portions 24*b*. In order to reduce cross-talk between such stacked conductors, which is especially prevalent at the termination thereof to IDC portions 24*b* and 26*b*, the present invention provides a conductor cross-talk shield 80.

Figure 3:
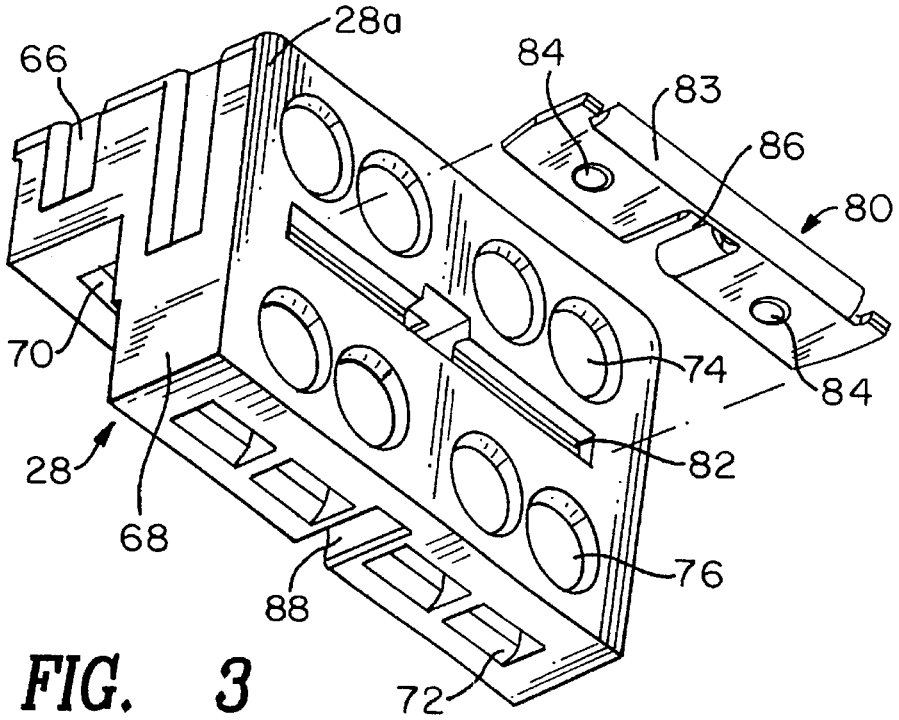
FIG. 3 is an enlarged perspective showing of the conductor holding block and contact shield of the connector of FIG. 1.
Figure 4:
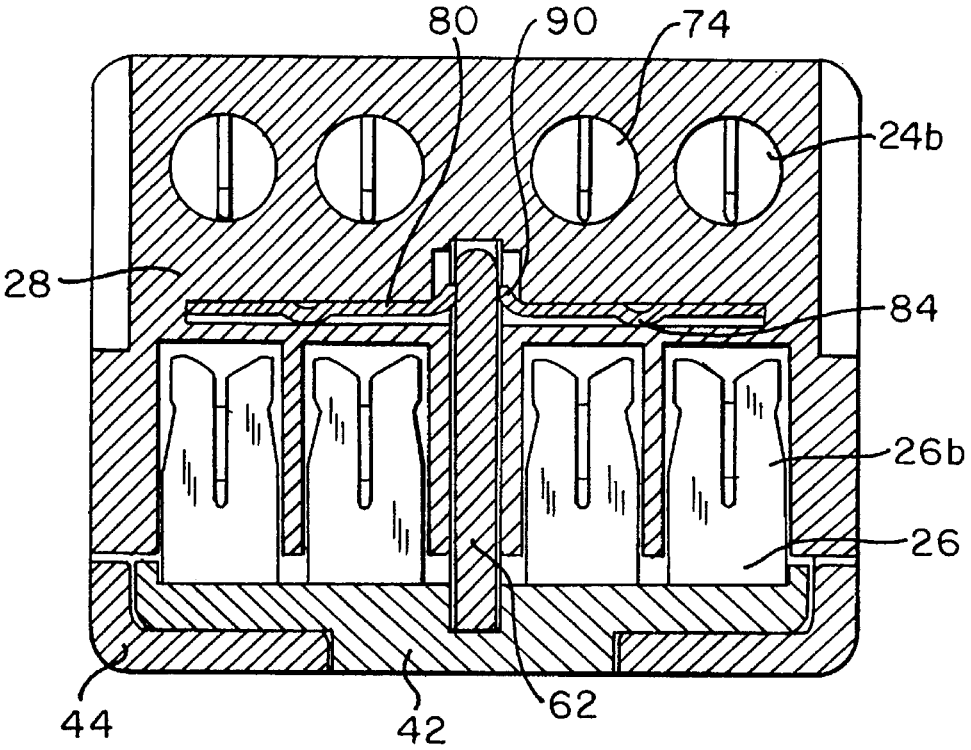
FIG. 4 is an enlarged sectional showing of the conductor holding block assembled to the termination subassembly shown in FIG. 2.

As shown in FIGS. 3 and 4, cross-talk shield 80 is an elongate generally planar member formed of suitably conductive metal. Shield 80 is supported within holding block 28 in a horizontal channel 82 which is generally parallel to, and located between, rows of passages 74 and 76. A longitudinal stiffing rib 83 positioned along the length of shield provides structural stability.

As shown in FIG. 4, when positioned in channel 82, shield 80 overlies the upper extents of IDC portions 26*b* of lower contacts 26. In order to captively retain shield within channel 82, shield 80 includes extending protrusions 84 which are frictionally received within channels 82. Shield 80 further includes a centrally-located notch 86 which is alignable with a vertical groove 88 in conductor holding block 28. Groove 88 is positioned between side-by-side pairs of passageways 74 and 76 and permits accommodation therein of vertical shield wall 62 upon assembly of contact support member 42 to outer conductive shield 44. In order to establish electrical ground-path continuity between outer conductive shield 44 and cross-talk shield 80, shield 80 includes a pair of inwardly facing curved surfaces 90 adjacent notch 86. Curved surfaces 90 permit frictional accommodation of vertical shield wall 62 within notch 86, so as to establish mechanical and electrical engagement therebetween. As cross-talk shield 80 spans row 26*d* of IDC portions 26*b*, effective electrical shielding is provided between the conductors 18 terminated by IDC portions 26*b* and the upper row of conductors 18 extending thereover. In combination with outer conductive shield 44 which is placed in electrical continuity therewith, cross-talk shield 80 provides effective shielding between pairs of upper and lower contacts 24 and 26 terminated to conductors 18.

While in the preferred embodiment shown in FIGS. 3 and 4, shield 80 is carried by holding block 28 for movement therewith, shield 80 may be supported at other locations within housing 20. For example, shield 80 may be supported between the depending sidewalls 32*a* of cover 32 (FIG. 1) for positioning adjacent the IDC portions upon attachment of cover 32 to base 30.

Referring again to FIG. 1, the termination of cable 12 with connector 10 of the present invention may be described. Conductors 18 are supported within passages 74 and 76 of holding block 28. Holding block 28 supporting all eight conductors 18 is inserted over contact accommodating end 46 of termination subassembly 22. All eight conductors are mass-terminated in unison with the IDC portions of contacts 24 and 26. Such termination is achieved at the longitudinally offset and vertically spaced positions of IDC portions 24*b* and 26*b*. An appropriate tool may be used to force holding block 28 over the IDC portions. Such movement also causes shield 80 to overlie IDC portions 26*b* of contacts 26, shielding the terminations of conductors 18 thereto from the conductors extending thereover. Also shield 80 is moved into electrical engagement with wall 62 establishing ground continuity with outer conductive shield 44. Termination subassembly 22 now terminated to conductors 18 of cable 12 is inserted between base 30 and cover 32 of housing 20. Appropriate strain relief hardware 90 may be employed to secure cable 12 to housing 20. Such hardware also may be used to electrically common the metallic shield 16 of cable 12 to the metallic plating of housing 20 and/or conductive shield 44 in a manner which is well-known in the art. The snap-fitting of cover 32 onto base 30 completes the termination of cable 12 and allows connector 10 to be interconnected with a mating electrical connector.

Various changes to the foregoing described and shown structures would now be evident to those skilled in the art. Accordingly, the particularly disclosed scope of the invention is set forth in the following claims.

We claim:

1. An electrical connector comprising:

an elongate connector housing having a connector interconnection end and an opposed cable termination end;

a plurality of elongate electrical contacts supported by said housing, said contacts having interconnection portions adjacent said interconnection end of said housing and insulation displacing contact portions adjacent said cable termination end, said insulation displacing contact portions being arranged in transversely aligned, longitudinally offset and vertically spaced pair of contact rows within said housing, each said contact row including at least two said contacts;

a conductor holding block, insertably movably supportable by said housing with respect to said insulation displacing contact portions, said conductor holding block including contact slots which are arranged therein in transversely aligned, longitudinally offset and vertically spaced rows for receipt of said insulation displacement contact portions upon said insertable movement of said holding block, said conductor holding block further including transversely aligned vertically spaced conductor receiving passages in communication with said contact slots for receipt of said conductors, the conductor receiving passages being generally aligned in a pair of vertically spaced rows, one row of passages being alignable with said insulation displacing contact portions of one of said contact rows; and a conductor shield positioned within said holding block between said rows of conductor receiving spaces and overlying said insulation displacing contact portions of one of said contact rows;

wherein said insertable movement of said conductor holding block effects simultaneous insulation displacing electrical connection of said conductors with said rows of insulation displacing contact portions.

2. An electrical connector of claim 1 wherein said conductor shield spans said rows of conductor receiving passages of said conductor holding block.

3. An electrical connector of claim 1 wherein said conductor shield overlies said insulation displacing contact portions of one row upon said insertable movement of said conductor holding block.

4. An electrical connector of claim 3 further including an electrically conductive housing shield having a vertical shield wall positioned between insulation displacing contact portions of one said row, said vertical shield wall being mechanically and electrically engageable with said conductor shield upon said insertable movement of said conductor holding block.

5. An electrical connector of claim 4 wherein said conductor shield is retentively secured within said conductor holding block.

6. An electrical connector of claim 5 wherein said vertical shield wall is retentively secured by said conductor shield.

7. A shielded electrical connector for terminating insulated conductors comprising:

an elongate connector housing;

a conductive housing shield overlying said connector housing;

plural electrical contacts supported by said housing, said contacts including insulation displacing contact portions aligned in a side-by-side row;

a conductor holding block insertably supportable by said housing, said holding block having conductor support elements for supporting said conductors over said aligned row of insulation displacing contact portions for movement into insulation displacing electrical engagement therewith upon said insertion of said holding block, said holding block including contact slots for accommodating said insulation displacing contact portions, and said conductor support elements including conductor passages extending through said holding block, said passages being in communication with said slots, said insulation displacing contact portions being positioned in a pair of transversely aligned, vertically spaced rows, said rows being longitudinally offset, said conductor holding block including said conductor passages being positioned in a pair of transversely aligned, vertically spaced rows; and a generally planar shield supported by said holding block for overlying disposition with respect to said aligned row of insulation displacing contact portions upon said insertion of said holding block, said planar shield being supported by said conductor holding block between said vertically spaced rows of passages, wherein said planar shield is mechanically and electrically engageable with said housing shield conductor holding block including an elongate channel extending over said conductor passages, said channel accommodating therein said planar shield.

8. In combination: a multi-conductor electrical cable and an elongate electrical connector terminating said cable, said combination comprising:

an elongate connector housing accommodating said conductors in a pair of vertically spaced conductor rows;

a plurality of side-by-side electrical contacts arranged in a pair of transversely aligned, vertically spaced rows, said contacts having insulation displacing contact portions extending in a uniform direction with said insulation displacing contact portions of one row being longitudinally spaced from the insulation displacing portions of the other row, said insulation displacing contact portions terminating individually said conductors of said multi-conductor cable; and a conductive shield supported within said connector housing between said vertically spaced conductor rows and overlying one said row of insulation displacing contact portions, said conductive shield providing electrical shielding between said conductor rows adjacent the termination of said conductors to said one row of insulation displacing contact portions.

9. In combination a multi-conductor electrical cable and an elongate electrical connector terminating said cable, said combination comprising:

an elongate connector housing accommodating said conductors in a pair of vertically spaced conductor rows;

a plurality of side-by-side electrical contacts arranged in a pair of transversely aligned, vertically spaced rows, said contacts having insulation displacing contact portions extending in a uniform direction with said insulation displacing contact portions of one row being longitudinally spaced from the insulation displacing portions of the other row, said insulation displacing contact portions terminating individually said conductors of said multi-conductor cable;

a conductive shield supported within said connector housing between said vertically spaced conductor rows and overlying one said row of insulation displacing contact portions, said conductive shield providing electrical shielding between said conductor rows adjacent the termination of said conductors to said one row of insulation displacing contact portions; and a conductor holding block having passages therein which individually support said conductors, said passages being arranged in two transversely aligned and vertically spaced rows, said conductor holding block further including slots accommodating therein said insulation displacing contact portions, said conductor holding block being insertably supported by said holding block for placing said conductors in insulation displacing electrical connection with said insulation displacing contact portions, wherein said conductive shield is supported by said conductor holding block and wherein said shield is supported between said vertically spaced rows of passages within said holding block.

10. A combination of claim 9 wherein said conductor holding block includes a channel between said rows of passages accommodating therein said shield.

11. An electrical connector comprising:

an elongate connector housing having a connector interconnection end and an opposed cable termination end;

a plurality of elongate electrical contacts supported by said housing, said contacts having interconnection portions adjacent said interconnection end of said housing and insulation displacing contact portions adjacent said cable termination end, said insulation displacing contact portions being arranged in transversely aligned, longitudinally offset and vertically spaced rows within said housing;

a conductor holding block, insertably movably supportable by said housing with respect to said insulation displacing contact portions, said conductor holding block including contact slots which are arranged therein in transversely aligned, longitudinally offset and vertically spaced rows for receipt of said insulation displacement contact portions upon said insertable movement of said holding block, said conductor holding block further including transversely aligned vertically spaced conductor receiving passages in communication with said contact slots for receipt of said conductors;

a conductor shield positioned within said holding block between the vertically spaced conductor receiving passages for providing electrical shielding between conductor rows adjacent the cable termination end, wherein said insertable movement of said conductor holding block effects simultaneous insulation displacing electrical connection of said conductors with said rows of insulation displacing contact portions.

12. An electrical connector of claim 11 wherein said electrical contacts are generally aligned in a pair of contact rows, each said contact row including at least two said contacts.

13. An electrical connector of claim 11 further including an electrically conductive housing shield positioned between the vertically spaced rows of electrical contacts.

14. An electrical connector of claim 13 wherein said conductor holding block includes said conductor receiving passages being generally aligned in a pair of vertically spaced rows, one row of passages being alignable with said insulation displacing contact portions of one of said contact rows.

15. An electrical connector of claim 14 wherein the electrically conductive housing shield includes a vertical shield wall positioned between insulation displacing contact portions of one said row, said vertical shield wall being mechanically and electrically engageable with said conductor shield upon said insertable movement of said conductor holding block.

16. A combination of claim 8 further including:

a conductor holding block having passages therein which individually support said conductors, said passages being arranged in two transversely aligned and vertically spaced rows, said conductor holding block further including slots accommodating therein said insulation displacing contact portions, said conductor holding block being insertably supported by said holding block for placing said conductors in insulation displacing electrical connection with said insulation displacing contact portions.

17. A combination of claim 16 wherein said conductive shield is supported by said conductor holding block.

* * * * *